US005103214A

United States Patent [19]

Curran et al.

[11] Patent Number: 5,103,214

[45] Date of Patent: Apr. 7, 1992

[54] AUXILIARY ALARM

[75] Inventors: Timothy G. Curran, Ramsey; Mark A. Toycen, St. Paul, both of Minn.

[73] Assignee: Minnesota Mining and Manufacturing Company, St. Paul, Minn.

[21] Appl. No.: 579,305

[22] Filed: Sep. 7, 1990

[51] Int. Cl.[5] ..... G08B 3/00; H04R 17/00; F04B 21/00

[52] U.S. Cl. ..... 340/691; 340/292; 340/573; 340/515; 417/572; 367/157

[58] Field of Search ..... 340/691, 292, 515, 506–508, 340/573, 618, 384 R, 393–394, 825.16, 825.19, 407; 364/555; 367/197, 157; 377/2; 417/313, 572

[56] References Cited

U.S. PATENT DOCUMENTS

| | | | |
|---|---|---|---|
| 3,641,570 | 2/1972 | Thompson | 340/409 |
| 3,835,333 | 9/1974 | Balan | 307/64 |
| 4,189,720 | 2/1980 | Lott | 340/539 |
| 4,207,559 | 6/1980 | Meyer | 340/506 X |
| 4,241,335 | 12/1980 | Barnes | 340/507 |
| 4,337,466 | 6/1982 | Spahn | 340/870.09 |
| 4,380,759 | 4/1983 | Sulkoski et al. | 340/407 |
| 4,417,235 | 11/1983 | Del Grande | 340/531 |
| 4,520,349 | 5/1985 | Varano | 340/531 |
| 4,570,155 | 2/1986 | Skarman et al. | 340/531 |
| 4,623,878 | 11/1986 | Schoenwetter | 340/628 |
| 4,636,777 | 1/1987 | Skerritt | 340/635 |
| 4,647,913 | 3/1987 | Pantus | 340/506 |
| 4,651,677 | 3/1987 | de Wit et al. | 119/20 |
| 4,755,792 | 7/1988 | Pezzolo et al. | 340/538 |
| 4,801,938 | 1/1989 | Holmes | 342/20 |
| 4,812,827 | 3/1989 | Scripps | 340/693 |
| 4,818,997 | 4/1989 | Holmes | 342/20 |
| 4,827,244 | 5/1989 | Bellavia et al. | 340/514 |
| 4,833,453 | 5/1989 | Twerdochlib | 340/540 |
| 4,843,378 | 6/1989 | Kimura | 340/635 |
| 4,897,862 | 1/1990 | Nishihara et al. | 379/40 |
| 4,901,056 | 2/1990 | Bellavia et al. | 340/514 |

FOREIGN PATENT DOCUMENTS

| | | | |
|---|---|---|---|
| 92804 | of 1983 | Japan | 367/197 |

*Primary Examiner*—Jin F. Ng
*Assistant Examiner*—Thomas J. Mullen, Jr.
*Attorney, Agent, or Firm*—Gary L. Griswold; Walter N. Kirn; Jeffrey J. Hohenshell

[57] ABSTRACT

The present invention comprises an audio alarm for providing a back-up acoustic output in response to a sensed parameter including a first audio alarm circuit having a first transducer for providing a first acoustic output in response to the sensed parameter, a second audio alarm circuit having a second transducer which provides the back-up acoustic output in response to a predetermined fault condition, and which is acoustically coupled to the first transducer. The second audio alarm circuit provides an electrical signal by converting the first acoustic output of the first transducer into an electrical signal. A detector circuit is connected to the first and second audio alarm circuits and responds to the sensed parameter and to the electrical signal from the second audio alarm circuit to provide the predetermined fault condition by interpreting the electrical signal from the second audio alarm circuit. After the detector circuit has determined that the predetermined fault condition exists, the detector circuit induces the second transducer to provide the back-up acoustic output as a result of the failure of the first transducer to provide the first acoustic output. The audio alarm circuit also provides several auto-diagnostic features for informing a user of internal failures in the audio alarm circuit itself.

20 Claims, 6 Drawing Sheets

AUXILIARY ALARM

TECHNICAL FIELD

The present invention relates generally to audible alarm circuits having internal auxiliary or "back-up" alarm features.

BACKGROUND ART

The art is replete with devices that are capable of detecting a condition associated with a medical device which may result in adverse consequences for a patient. An example of such a device is a sensor used in a large volume infusion pump capable of detecting the exhaustion of a fluid reservoir. Another example of a sensor associated with a large volume infusion pump is a conventional air-in-line sensor for detecting air bubbles in a line used to deliver fluid. Each of these sensors detect a condition that is potentially dangerous for the patient. These types of conditions are referred to in this application as "sensed parameters".

A typical alarm used in conjunction with medical equipment consists of an alarm used to inform a user of the existence of a sensed parameter. A failure of the alarm however, prevents the alarm signal from reaching a user, a potentially dangerous result.

DISCLOSURE OF THE INVENTION

The present invention provides an audio alarm circuit that provides an internal auxiliary or "back-up" alarm feature in which the same element is used as both the sensor for detecting whether the first alarm has properly responded to a sensed parameter and as the secondary or "back-up" alarm for responding to the sensed parameter upon the failure of the first alarm.

According to the present invention there is provided an audio alarm that delivers a back-up acoustic output in response to a sensed parameter such as the detection of an air bubble in a conduit used to deliver fluid to the body of a patient. The alarm circuit comprises a first audio alarm circuit having a first transducer for providing a first acoustic output in response to the detection of an air bubble in a conduit used to deliver fluid to the body of a patient. The alarm circuit further comprises a second audio alarm circuit having a second transducer which provides the back-up acoustic output in response to a predetermined fault condition such as a failure of the first audio alarm circuit to produce the first acoustic output.

The second audio transducer is acoustically coupled to the first transducer and in the preferred embodiment the transducers are piezoelectric transducers. The second audio alarm circuit provides an electrical signal by converting the first acoustic output of the first transducer into an electrical signal. A detector circuit is connected to the first and second audio alarm circuits and responds to the sensed parameter (i.e. the detection of an air bubble in a conduit used to deliver fluid to the body of a patient) and to the electrical signal from the second audio alarm circuit. Once the detector responds to these conditions, the detector recognizes the predetermined fault condition (i.e. the failure of the first audio alarm circuit to produce the first acoustic output) and causes the second transducer to provide the back-up acoustic output.

BRIEF DESCRIPTION OF THE DRAWING

The present invention will be further described with reference to the accompanying drawing wherein like reference numerals refer to like parts in the several views, and wherein.

DETAILED DESCRIPTION

Figure 1:
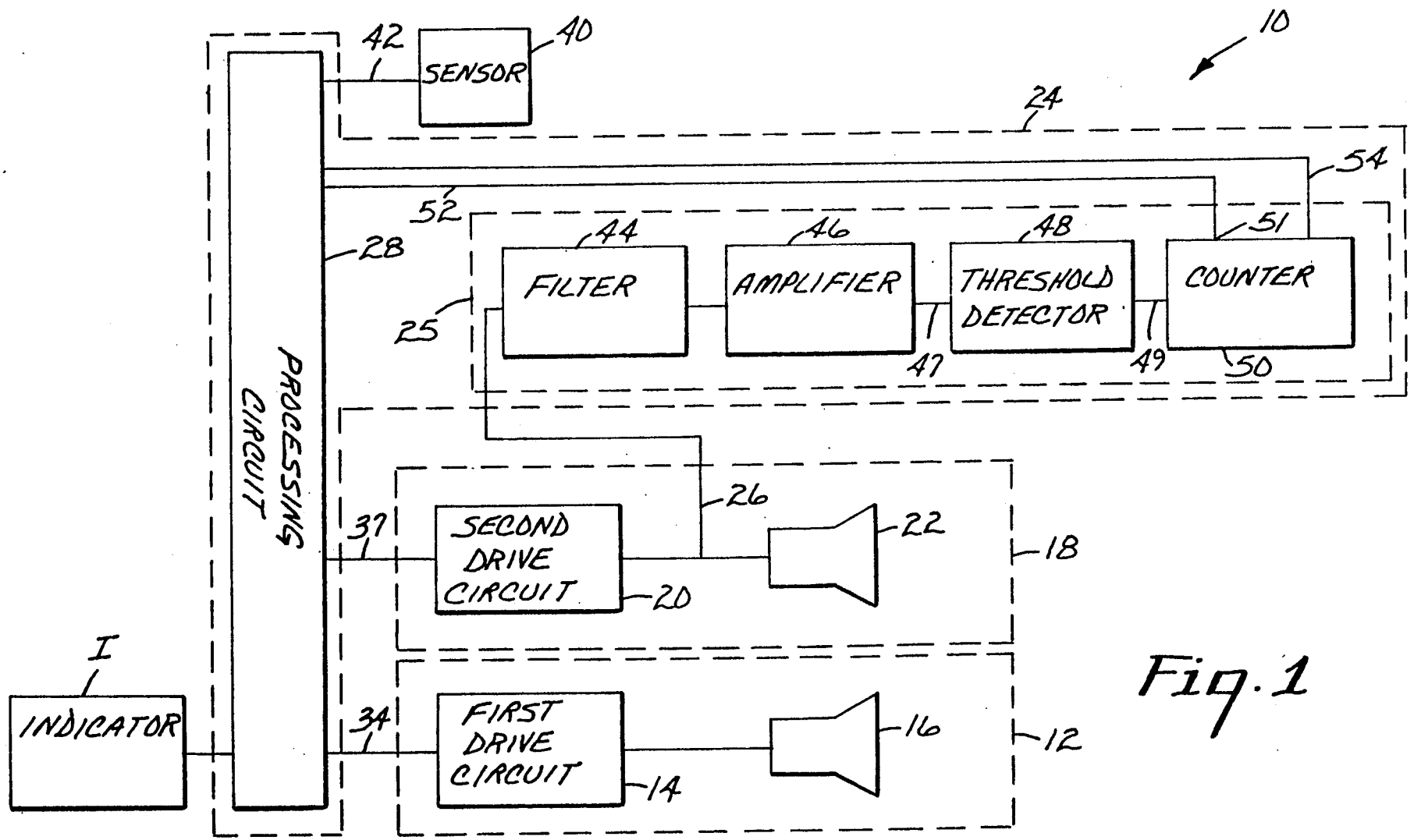
FIG. 1 is a block diagram of the audio alarm circuit of the present invention.

Referring now to FIG. 1 of the drawing, there is shown a block diagram of the audio alarm circuit, generally designated by the reference number 10. The audio alarm circuit 10 provides a back-up acoustic output in response to a sensed parameter, such as the detection of an air bubble in a conduit used to deliver fluid to the body of a patient, provided by a conventional sensor 40. The audio alarm 10 comprises a first audio alarm circuit 12 having a first transducer 16 for providing a first acoustic output in response to the sensed parameter, and a second audio alarm circuit 18 having a second audio transducer 22 which provides the back-up acoustic output in response to a predetermined fault condition, such as a failure of the first transducer 16 to provide the first acoustic output. The first audio alarm circuit 12 includes a first drive circuit 14 for driving the first transducer 16 and the second audio alarm circuit 18 includes a second drive circuit 20 for driving the second audio transducer 22.

The second audio transducer 22 is acoustically coupled to the first transducer 16; and the second transducer 22 provides an electrical signal on line 26 by converting the first acoustic output of the first transducer 16 into the electrical signal. The transducers 16 and 22 are preferably piezoelectric transducers since piezoelectric transducers are particularly suitable for converting audio energy into electrical energy. For example, a Model PZS27TP Piezoelectric Transducer, commercially available from NTK Technical Ceramics Division of Richardson, Tex. may be used.

The present invention further includes a detector circuit 24 that is responsive to a signal representative of a sensed parameter such as the detection of an air bubble in a conduit used to deliver fluid to the body of a patient. The signal representative of a sensed parameter is provided to the detector circuit 24 on line 42.

The detector circuit 24 is also responsive to the electrical signal on line 26 and provides the predetermined fault condition by interpreting the electrical signal provided on line 26. The predetermined fault condition is provided by the detector circuit 24 upon its recognition that the first transducer 16 has failed to provide the first acoustic output, whereupon the detector circuit 24 then induces the second audio transducer 22 to provide the back-up acoustic output.

Figure 4A:
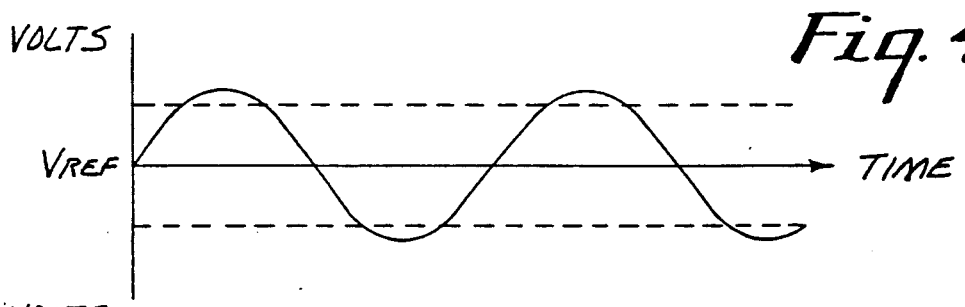
FIG. 4A is a graphical representation of an electrical signal supplied by the second transducer after it has been amplified by the amplifier shown in FIG. 1.

The detector circuit 24 includes a conditioning circuit 25 that receives the electrical signal on line 26 from the second transducer 22. Preferably, the conditioning circuit 25 includes a filter 44 (e.g. a bandpass filter connected to line 26) tuned to the same frequency as the first drive circuit 14 to filter undesirable ambient noise. The conditioning circuit 25 initially amplifies the electrical signal by means of an amplifier 46. FIG. 4A is a representation of the electrical signal present on line 47. Once the electrical signal is amplified, a threshold detector 48 converts the amplified electrical signal to a standardized or "countable" signal on line 49.

Figure 4B:
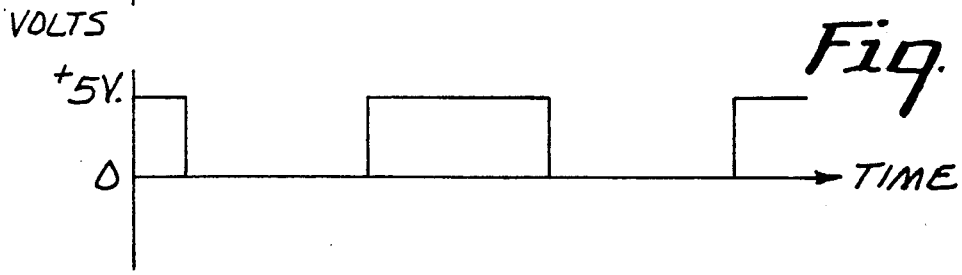
FIG. 4B is a graphical representation of the electrical signal described by FIG. 4A after it has been converted to a standardized, countable CMOS signal by the threshold detector 48 illustrated in FIG. 1.

FIG. 4B is a representation of the signal on line 49 after it has been converted to a countable signal by the threshold detector 48. The condition of the countable signal shown in FIG. 4B is particularly suitable for counting by a counter 50. The counter 50 includes a power input, an input from the second audio alarm circuit 18 on line 49, a reset port 51, and an output to line 54. The "count" provided by the counter 50 is a representation of the output over a period of time of the second transducer 22 that is present on line 26 and which is conditioned by the filter 44, the amplifier 46 and the threshold detector 48. A suitable counter for this purpose is a Counter Chip Model MC14060 available from Motorola of Austin, Tex.

The detector circuit 24 further includes a processing circuit 28 that receives the count from the conditioning circuit 25 on line 54, compares the count from the conditioning circuit 25 with preprogrammed, predetermined parameters, and induces the second audio transducer 22, via line 37, to provide the back-up acoustic output if the count fails to be within the. predetermined parameters.

Figure 3:
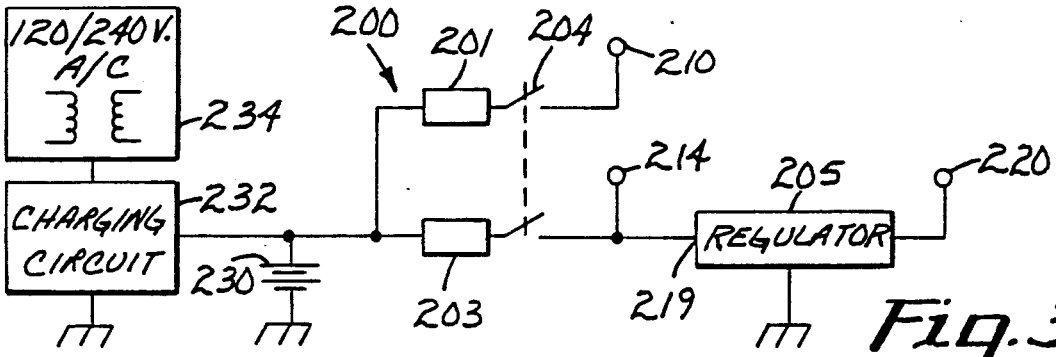
FIG. 3 is a schematic diagram of an example of a power supply that is used with the circuit shown in FIG. 2.

FIG. 1 also illustrates an optional sensor circuit 40 which communicates the presence of a sensed parameter to the processing circuit 28 on line 42. Several sensor circuits 40 may be used to monitor whether a sensed parameter exists. The sensor 40 may be any sensor that has the capacity to detect a condition which is potentially harmful for a patient. The audio alarm 10 also includes auto-diagnostic features, later to be explained in greater detail, which sense or respond to the existence of a sensed parameter within the audio alarm circuit 10 itself, such as a failure in the power circuit 200 (FIG. 3). The auto-diagnostic features may utilize an optional indicator I such as, but not limited to a separate acoustic alarm with a distinctive alarm frequency, a visual indicator or a numeric display.

Figure 2:
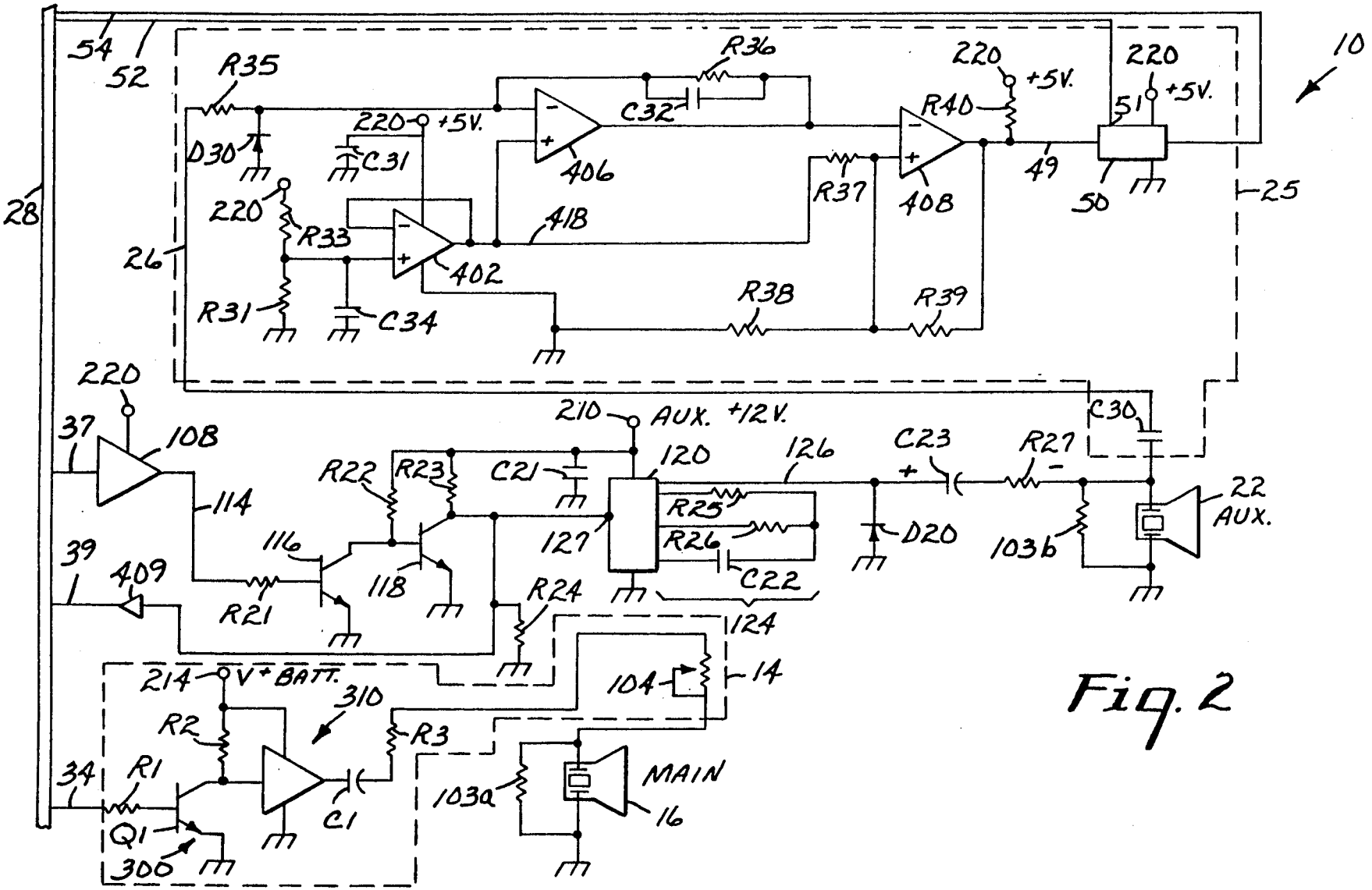
FIG. 2 is a schematic diagram illustrating a particular embodiment of the audio alarm described in FIG. 1.

Referring now to FIGS. 2 and 3, FIG. 2 is a schematic diagram illustrating a particular embodiment of the audio alarm 10 shown in FIG. 1, and FIG. 3 illustrates a preferred embodiment of a power circuit 200 used to power the audio alarm circuit 10 shown in FIG. 2. The power circuit 200 includes a twelve volt battery 230 which is continually charged by a charging circuit 232 that is powered by a standard wall circuit 234 (shown in FIG. 3 as a transformer). A double pole single throw switch 204 having a pair of fuses 201 and 203, and a voltage regulator 205 having an input 219 and an output 220 are also present in the power circuit 200. Preferably, the voltage at locations 210 and 214 remain at 12 volts while the voltage on line 220 is regulated by a regulator 205 to 5 volts. A five volt DC signal is hereafter referred to as logic 1 or a "high" signal, while a voltage of approximately zero volts will be referred to as logic 0 or a "low" signal.

Referring now to FIG. 2, the sensor 40 and the indicator I have been omitted for clarity. At time t=0, the processing circuit 28 is informed of the existence of a sensed parameter (such as an air bubble in a fluid conduit) by the sensor 40. Shortly thereafter, the processing circuit 28 initially sends a reset signal on line 52 into the reset port 51 of the ccunter 50 to reset the counter 50 and coinstantaneously starts a clock element (not shown) within the processing circuit 28. Next, the processing circuit 28 initiates the first acoustic output from the first alarm circuit 12 by sending a square wave train on line 34 at the frequency of the audible tone desired (e.g. 3000 Hz). The processing circuit 28 controls the operation of the alarm circuit 10 by means of a programmed operational routine stored in its associated memory.

The first drive circuit 14 receives the square wave train on line 34. The first drive circuit 14 comprises a level converter 300 for +5 to +12 volts including a resistor R1 for bias current and a transistor Q1 for switching purposes. A resistor R2 for pull up to 12 volts, a power supply input connected to line 214 for powering the first transducer 16, and an isolation capacitor C1 are also present in the first drive circuit 14. A fixed resistor R3 for limiting current and volume control over the tone emitted by the first audio transducer 16, a variable resistor 104 for manual volume control, and a buffer or driver 310 for powering the transducer comprise the remainder of the first drive circuit. The first audio output signal on line 34 is conditioned to induce the first drive circuit 14 to drive the first audio transducer 16, and, as stated above, may comprise a square wave.

When the audio alarm circuit 10 is functioning properly (i.e. the first transducer 16 produces audio output in response to the sensed parameter), the second audio transducer 22 converts a portion of the first audio output into an electrical signal on line 26. The electrical signal present on line 26 passes into the conditioning circuit 25 and initially encounters a filter 44 and an amplifier 46. The filter 44 and amplifier 46 are combined and include a capacitor C30, resistors R35, R36, operational amplifier (op-amp) 406 and capacitor C32. A reference voltage is also utilized to establish a DC voltage level output of op-amp 406 that is approximately one-half the supply voltage. The voltage reference on line 418 is created by op-amp 402, resistor dividers R31, R33, the five volt supply 220 and capacitor C34.

A band pass filter with the passband set to the frequency at which the first drive circuit 14 is tuned is provided to assist the conditioning circuit 25 in discriminating between actual audio output from the first audio transducer 16 and random noise from the environment. After the amplifier 406 boosts the signal to a suitable amplitude (FIG. 4A), the signal is converted to a countable signal on line 49 by means of the threshold detector 408 using the amplifier 402 to form a DC reference ($V_{ref}$). The countable signal shown in FIG. 4B preferably comprises a CMOS logic signal but could be any standardized logic signal that is readily counted. Resistors R37, R38, R39, R40, capacitor C31 and rectifier D30 are also present to support in the amplifier, filter and counting functions of the conditioning circuit 25.

The second drive circuit 20 includes a buffer 108 having an input on line 37. The value of logic on line 37 is usually 1, changing to 0 to request acoustic output from the second transducer 22. Correspondingly, the value of the logic on line 114 is normally 1 changing to 0 when the logic on line 37 is changed from 1 to 0. A pair of transistors 116 and 118 operate on the battery voltage on line 210 and normally direct a logic value of 1 to an inhibit port 127 of an oscillator/divider 120 when the logic on line 114 is 1. When the logic on line 114 is 1, the transistors 116, 118 prevent the oscillator/-divider 120 from driving the second transducer 22 to produce acoustic output. However, when the logic input into the inhibit port 127 changes to a logic value of 0, (as when the logic value on line 114 changes to 0), the oscillator/divider 120 provides an alarm signal (such as a square wave output having a frequency in the audible range, e.g. 2500 Hz), on line 126 to drive the second audio transducer 22.

A resistor/capacitor network 124 comprising a capacitor C22, and a pair of resistors R25, R26 is present to provide the oscillator/divider 120 with a tuned circuit for an oscillator function. The oscillator/divider 120 utilizes the voltage on line 210 to drive the second audio transducer 22. Resistors R21, R22, R23, R24, R27, capacitor C21 and rectifier D20 assist the second audio drive circuit 20 in eliciting the acoustic output from the second audio transducer 22 and are also elements of auto-diagnostic features which are explained in greater detail infra.

When the transducers 16 and 22 are piezoelectric in nature, relatively large (e.g. one megohm) bleed resistors **103*a* and 103*b* are present. The bleed/resistors 103*a* and 103*b* cooperate with the isolation capacitors Cl and C23** to remove direct current voltage bias from the transducers, thereby enhancing their reliability.

Figure 5:
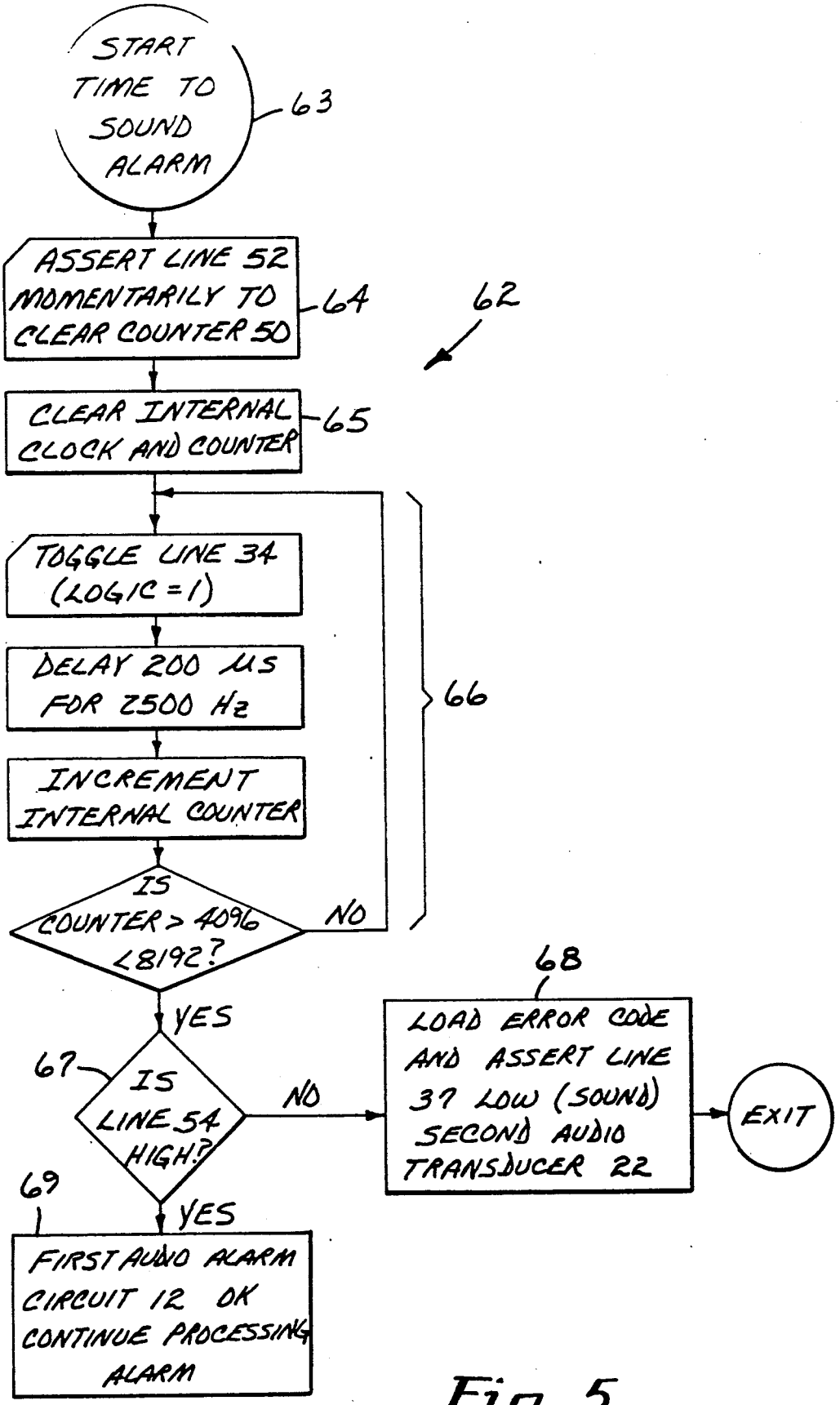
FIG. 5 is a flowchart describing the programming steps used to program the microprocessor of the circuit shown in FIG. 2 to provide back-up acoustic output from the second transducer upon failure of the first transducer to produce acoustic output.

FIG. 5 is a flowchart 62 illustrating an example of a programmed operation or routine that enables the processing circuit 28 to determine whether the first audio alarm 12 is functioning properly. The programmed operation or routine illustrated in FIG. 5 is stored in the program memory associated with the processing circuit 28.

At time t=0, the initial step 63 of the programmed operation of the processing circuit 28 is triggered when the sensor 40 informs the processing circuit 28 of the existence of a sensed parameter, such as an air bubble in a fluid conduit. After the sensor 40 notifies the processing circuit 28 that a sensed parameter exists, the processing circuit 28 proceeds to prepare the internal features of the alarm circuit 10 in steps 64 and 65 by asserting line 52 momentarily to clear the counter 50 (step 64) and clearing an internal clock element within the processing circuit 28 (step 65).

Next, the programmed operation of the the processing circuit 28 proceeds to a decision step 66. During the decision step 66, the processing circuit 28 monitors the logic level of one of the higher binary digits of the count performed by counter 50 via line 54, and compares the results of the count with predetermined parameters representative of proper transducer operating characteristics. The predetermined parameters are preprogrammed into the processing circuit 28 according to the flowchart of FIG. 5.

The preprogrammed, predetermined parameters representative of proper transducer operating characteristics correspond to the value of the count in the counter 50 that should exist if the first transducer 16 is producing audio output and that output is being converted into an electrical signal which is ultimately received in the conditioning circuit 25 via line 26. For example, if the twelfth binary digit is monitored, the processing circuit 28 expects that the twelfth binary digit of the counter 50 will "go high" (e.g. to a logic 1) after 4096 clock cycles from the reset signal on line 52, and then low after 8192 clock cycles. In this example, the predetermined parameters preprogrammed into the processing circuit 28 are a twelfth binary digit that goes high (to a logic of 1) 4096 clock cycles after the reset signal to the counter 50 (step 64) and then goes low (i.e. a logic of 0) after 8192 clock cycles.

At block 67, the processing circuit 28 determines whether the actual output on line 54 is commensurate with the predetermined parameters. If the output on line 54 is not within the predetermined parameters then the processing circuit 28 proceeds to alarm step 68 and generates the predetermined fault condition and sends an audio request signal on line 37 to induce the second audio drive circuit 20 to cause the second transducer 22 to produce the back-up acoustic output. However, if the output on line 54 is within the predetermined parameters, then the processing circuit 28 progresses to confirmation step 69 where the first audio alarm 12 continues to process the first acoustic output.

The alarm circuit 10 includes several internal auto-diagnostic features. A first auto-diagnostic feature is present within the second audio alarm circuit 18. If there is a failure in the power circuit 200 such as a failure of the fuse 203 (FIG. 3) or a failure of the regulator 205 resulting in logic 0 on line 220, then the value of the logic on line 114 will be zero as a result of the power failure and thus the value of the logic at the inhibit port 127 is zero. When the logic into the inhibit port 127 is 0, the oscillator/divider 120 utilizes the voltage on line 210 to produce audio output from the second transducer 22. Thus, the second drive circuit 20 will automatically sound the second transducer 22. As long as the voltage on line 210 remains uninterrupted, the audio alarm circuit 10 automatically provides acoustic output in response to a power failure such as a failure of the fuse 203 or a failure of the regulator 205.

Figure 6:
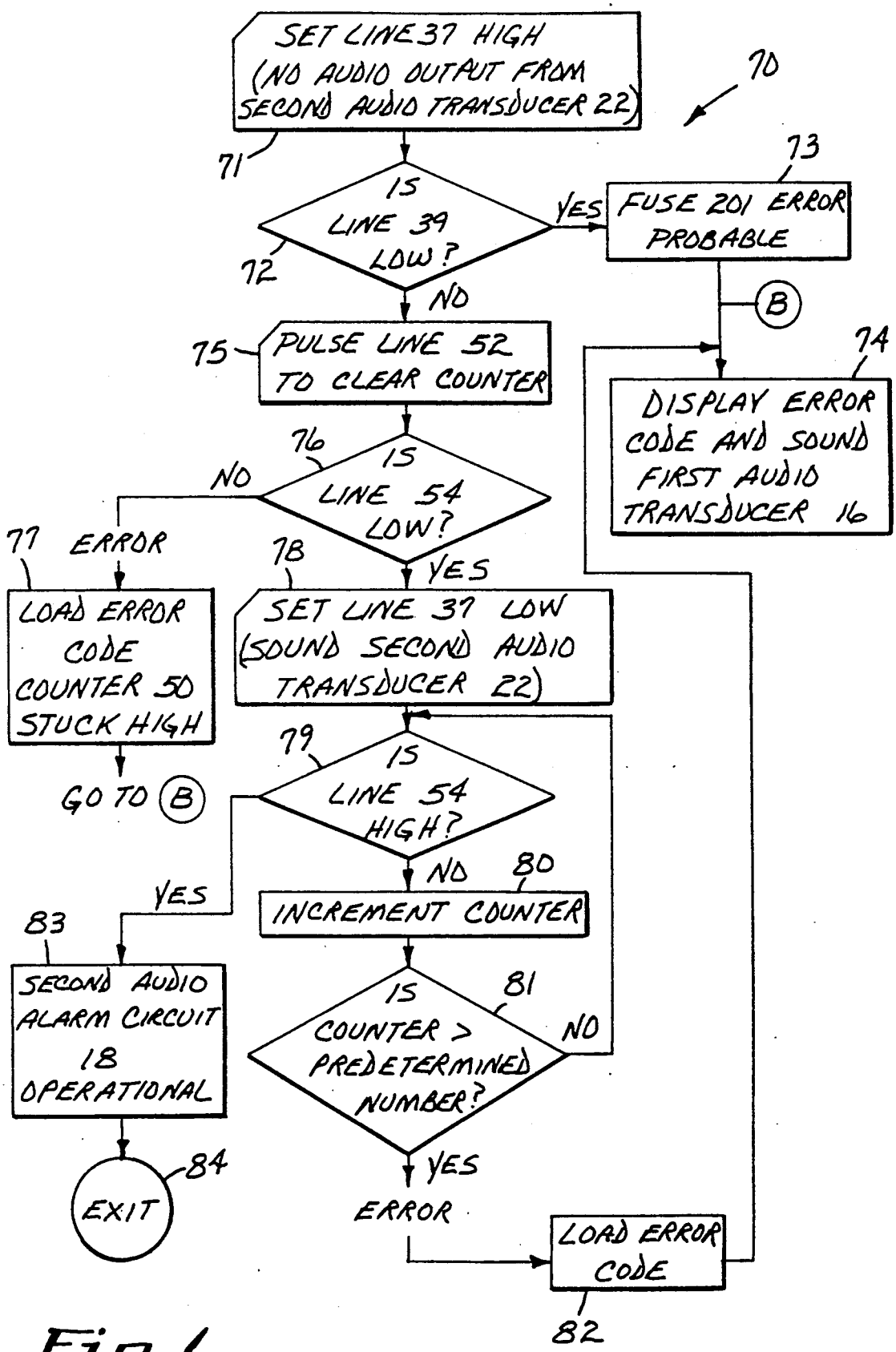
FIG. 6 is a flowchart describing the programming steps used to program the microprocessor of the circuit shown in FIG. 2 for establishing an auto-diagnostic feature.

FIG. 6 is a flowchart 70 illustrating the operational routine for the processing circuit 28 for a second auto-diagnostic feature utilizing an auto-diagnostic line 39 (FIG. 2) with level shifter 409. A suitable level shifter for this purpose is MC14049 available from Motorola of Austin, Tex. The second auto-diagnostic feature is used to determine whether the second audio alarm circuit 18 and the conditioning circuit 25 are functioning properly and to signal a user if they are defective. Similar to the programmed routine illustrated by FIG. 5, the operational routine shown in FIG. 6 is stored in associated program memory of the processing circuit 28.

The programmed routine illustrated in FIG. 6 may be programmed to run periodically to test the elements of the alarm circuit 10 or may be programmed to begin to run upon power up of the alarm circuit 10. Once the programmed routine has begun to run, the routine begins with initial step 71 where the processing circuit 28 is programmed to set line 37 high to prevent the second audio transducer 22 from providing acoustic output. Next, in decision step 72, the processing circuit 28 monitors line 39 to determine the voltage present at the inhibit port 127 of the oscillator/divider 120. If the logic on line 39 is low while line 37 is at logic 1, as at block 73 in FIG. 6, then there is a failure in the second audio alarm circuit 18 such as a power failure at 210 as a result of a defective fuse 201, and the processing circuit 28 will proceed to failure indicating step 74 to display a code on numeric display I and to sound the first audio transducer 16.

If the logic on line 37 is high and the logic on line 39 is high, then the functioning of the second audio alarm circuit 18 between line 37 and inhibit port 127 is verified and the processing circuit 28 proceeds to preparation step 75 in order to further test the second audio alarm circuit 18. During the preparation step 75, the processing circuit 28 pulses line 52 to clear the counter 50 and then proceeds to a second decision step 76 to monitor the output on line 54.

Failure condition step 77 illustrates a condition where, subsequent to the pulsing of line 52 (step 75), the logic on each of lines 37, 39 and 54 is high, a condition indicating a failure in the alarm circuit 10 such as the counter 50 stuck at high logic. Upon recognizing that this condition is present, the processing circuit 28 advances to failure indicating step 74 to display a code on numeric display I and to sound the first audio transducer 16. In contrast, when the logic on line 54 is low and the logic on lines 37 and 39 is high, then the processing circuit 28 proceeds to testing step 78 to test the remaining portions of second audio alarm circuit 18 and the conditioning circuit 25 by initially setting the logic on line 37 low to elicit acoustic output from the second audio transducer 22.

As shown in blocks 79–84, when the logic value on line 37 is set low (zero) and the logic value at the inhibit port 127 is low (zero), the output of the conditioning circuit 25 on line 54 should be substantially the same as the output provided by the conditioning circuit 25 when the second transducer 22 converts the first acoustic output from the first transducer 16 into the electrical signal on line 26 (as in FIG. 5). Since there is no acoustic coupling and hence no signal attenuation, when the second audio transducer 22 is producing acoustic output, the signal on line 26 will be much stronger than the signal on line 26 when the second transducer 22 converts the acoustic output from the first transducer 16 to an electrical signal.

If the logic value at the inhibit port 127 is at a logic 0 and the signal on line 54 is not consistent with an indication that acoustic output was generated by the first transducer 16 after an appropriate delay (block 81), then there is a failure of the audio alarm circuit 10 and the processing circuit 28 proceeds to error recognition step 82 and subsequently to failure indicating step 74. Again, at failure indicating step 74, the processing circuit 28 is programmed to send a square wave train at the frequency of the audible tone desired (e.g. 2500 Hz) on line 34 to elicit audio output from the first transducer 16 to thereby provide an alarm signal despite the failure in the audio alarm circuit 10. Also, at failure indicating step 74, the processing circuit 28 displays an error code on a numerical display I.

If the signal on line 54 does change to high logic within the appropriate time delay (block 81), then the processing circuit 28 has verified that the second audio alarm circuit 18 and the conditioning circuit 25 are working properly and proceeds to verification step 83. This second auto-diagnostic feature may be programmed to run periodically but is especially useful at power-up or start-up of the alarm circuit 10.

A third auto-diagnostic feature is also particularly useful at power-up of the alarm circuit 10. The third auto-diagnostic feature is used to determine whether the second audio transducer 22 is properly converting the audio signal from the first transducer 16 into an electrical signal on line 26. Similar to the second auto-diagnostic feature, the third auto-diagnostic feature may be stored in the associated program memory of the processing circuit 28.

In the preferred embodiment of the third diagnostic feature, the processing circuit 28 periodically provides a test signal to the first audio alarm circuit 12 to induce the first audio alarm circuit 12 to provide a test acoustic output after sending a reset signal on line 52. The processing circuit 28 then monitors the conditioning circuit 25 to verify that the first and second audio alarm circuits 12, 18 are functioning properly. The verification is undertaken in a manner similar to the steps taken at decision step 66 of FIG. 5.

During the verification step of the third auto-diagnostic feature, the processing circuit 28 monitors the logic level of one of the higher binary digits of the count performed by counter 50 via line 54, and compares the results of the count with predetermined parameters representative of proper transducer operating characteristics. The preprogrammed, predetermined parameters representative of proper transducer operating characteristics correspond to the value of the count in the counter 50 that should exist if the first transducer 16 is producing the test audio output and that test output is being converted into an electrical signal which is ultimately received in the conditioning circuit 25 via line 26. For example, if the twelfth binary digit is monitored, the processing circuit 28 expects that the twelfth binary digit of the counter 50 will "go high" (e.g. to a logic 1) after 4096 clock cycles from the reset signal on line 52, and then low after 8192 clock cycles. In the third auto-diagnostic feature, the processing circuit 28 provides a failure signal (such as a signal on numeric display I) when it is unable to verify that the first and second audio alarm circuits 12, 18 are functioning properly.

This third auto-diagnostic detects catastrophic mechanical failure of the second audio transducer 22 where the second auto-diagnostic feature might fail to detect such a defect. The second auto-diagnostic feature may send a signal directly from the oscillator/divider 120 to line 26 bypassing the second audio transducer 22 thereby creating an erroneous signal on line 26 that the second audio transducer 22 is functioning properly (i.e. that acoustic energy is being converted to electric energy). In contradistinction, the third auto-diagnostic feature requires that the second audio transducer 22 convert the acoustic energy of the first audio transducer 16 into an electrical signal on line 26. The third auto-diagnostic feature also determines whether the first audio alarm circuit 12 is functioning properly as the second transducer 22 cannot convert acoustic output into an electrical signal unless the first audio alarm circuit 12 is actually producing acoustic output.

The efficiency with which the second audio transducer 22 converts the acoustic energy of the first audio transducer 16 into an electrical signal is an important feature in eliminating error signals due to ambient noise. If the second audio transducer 22 does not efficiently convert the output of the first audio transducer 16 into an electrical signal, then the conditioning circuit 25 should boost the signal on line 26 to provide a signal with a sufficient amplitude to be converted to a countable signal.

The amplification of the signal on line 26 is controlled by the value of the resistors R35 and R36 and capacitors C30 and C32. If the value of these components are set to provide a relatively large gain, however, the conditioning circuit 25 also tends to amplify ambient noises. Thus, the greater the amplifier gain, the greater the likelihood that ambient noise will cause an erroneous signal in the conditioning circuit 25. A highly efficient coupling between the first and second audio transducers 16, 22 provides a bulwark against erroneous signals within the conditioning circuit 25. With a highly efficient coupling, the gain may be reduced thereby reducing the likelihood of an erroneous signal within the conditioning circuit 25.

Figure 7:
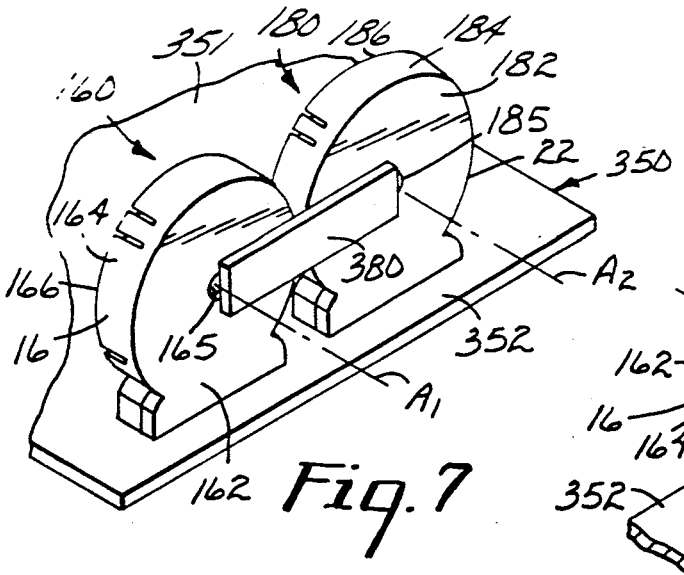
FIG. 7 is perspective view of a first embodiment of the placement of the transducers of the invention showing a baffle coupling the first and second audio transducers.
Figure 9:
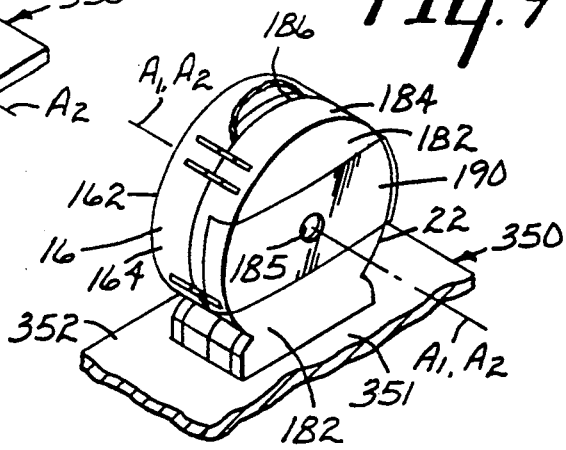
FIG. 9 is a perspective view of a third embodiment of the placement of the transducers of the present invention showing the transducers placed in a back-to-back relationship with a length of adhesive tape placed across the sound egress hole of the second audio transducer.
Figure 8:
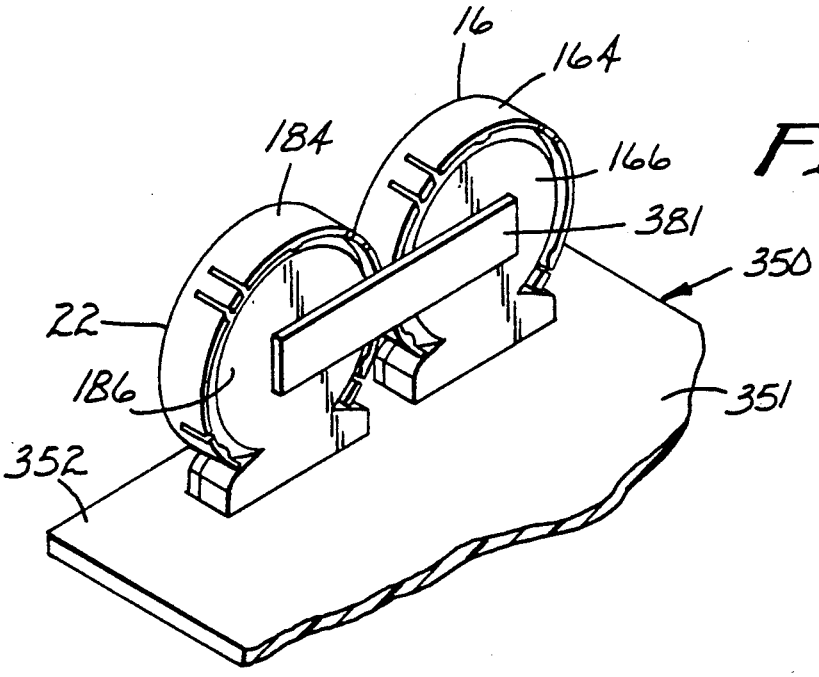
FIG. 8 is a perspective view of a second embodiment of the placement of the transducers of the present invention showing the relative positions of the transducers and a rigid member.

FIGS. 7–9 illustrate three embodiments for orienting the first and second transducers 16, 22 to enhance the efficiency of their acoustic coupling. FIG. 7 illustrates a physical layout of the first 16 and second 22 transducers on a circuit board 350. The first 16 and second 22 transducers each comprise a generally disc-shaped housing 160, 180 comprising a tubular peripheral wall 164, 184 having an axis A1, A2, axially spaced ends, and first end walls 162, 182 and second opposite end walls 166, 186 one attached to each end of the peripheral wall 164, 184. The first end walls 162, 182 have sound egress apertures 165, 185 adapted to direct passage of acoustic output therethrough in a direction generally parallel to the axes A1, A2.

In the embodiment shown in FIG. 7, the first transducer 16 and second transducer 22 are situated with the axis A1 of the first transducer 16 spaced from the axis A2 of the second transducer 22, and the transducers are coupled by an acoustic propagation member or baffle 380 to enhance the acoustic coupling therebetween. The baffle 380 at least partially covers the sound egress apertures 165, 185 to afford efficient transmission of acoustic output from the first transducer 16 to the second transducer 22. The embodiment shown in FIG. 7 illustrates the sound egress apertures 165, 185 facing the exterior 352 of the audio alarm 10 and the second end walls 166, 186 facing the interior 351 of the audio alarm 10. This orientation of the transducers 16, 22 affords broadcast of audio output through the sound egress apertures 165, 185 to a user.

Turning to the embodiment shown in FIG. 8, the first transducer 16 and second transducer 22 are situated as in FIG. 7. In FIG. 8, however, an acoustic propagation or rigid member 381 is attached by glue or other means to the end walls 166 and 186. The rigid member 381 provides a similar function as the baffle 380 of the embodiment shown in FIG. 7 in that it enhances the acoustic coupling between the first 16 and second 22 transducers.

FIG. 9 is directed to a third embodiment of the orientation of the first and second audio transducers 16, 22, showing the second end wall 166 of the first transducer 16 situated in contact with the second end wall 186 of the second transducer 22, the axis A1 of the first transducer 16 aligned with the axis A2 of the second transducer 22, and pressure sensitive adhesive tape 190 (FIG. 9) covering the sound egress aperture 185 of the second transducer 22.

The pressure sensitive tape 190 blocks the sound egress aperture 185 and allows the second transducer 22 to broadcast through the body of the first transducer 16 to the environment using the sound egress aperture 165 of the first transducer 16. The body of the first transducer 16 provides a resonance chamber for the audio output from the second transducer 22; and the contact between the second end walls 166, 186 of the first and second transducers 16, 22 enhances the acoustical coupling between the transducers 16, 22 and affords efficient conversion of the acoustic output of the first transducer 16 to an electrical signal by the second transducer 22. The arrangement of the transducers shown in FIG. 9 requires minimal space on the circuit board 350, requires only one opening in the container used to enclose the audio alarm 10 and provides the least number of additional elements as the need for a baffle 380 or rigid member 381 is obviated.

The present invention has now been described with reference to several embodiments thereof. It will be apparent to those skilled in the art that many changes or additions can be made in the embodiments described without departing from the scope of the present invention. For example, the filter 44, amplifier 46 and threshold detector 48 may comprise any conventional circuit adapted for their respective functions. Also, the first transducer 16 need not be a piezoelectric transducer as the first transducer 16 need only produce audio output and is not required to convert audio output to an electrical signal. Moreover, the transducers 16, 22 may utilize light or ultrasonic waves to transmit information rather than an audible wave. With respect to the acoustic coupling of the first and second transducers 16, 22, the use of a rigid circuit board may also be used to enhance the acoustic coupling between the first and second transducers 16, 22. Thus, the scope of the present invention should not be limited to the structures described in this application, but only by structures described by the language of the claims and the equivalents of those structures.

What is claimed is:

1. An audio alarm for providing a back-up acoustic output in response to a sensed parameter comprising:

a first audio alarm circuit having a first transducer providing a first acoustic output in response to the sensed parameter;

a second audio alarm circuit having a second transducer providing the back-up acoustic output in response to a predetermined fault condition, the second transducer being acoustically coupled to the first transducer; the second audio alarm circuit providing an electrical signal in response to the first acoustic output of the first transducer, and a detector responsive to the sensed parameter and to the electrical signal, the detector being adapted to provide the predetermined fault condition and cause the second transducer to provide the back-up acoustic output upon failure of the first transducer to provide the first acoustic output.

2. The audio alarm according to claim 1 wherein the detector further comprises a conditioning circuit for receiving the electrical signal from the second audio alarm circuit, the conditioning circuit being adapted to convert the electrical signal to a countable signal representative of transducer operating characteristics and to provide a count of the countable signal; and a processing circuit for receiving the count from the conditioning circuit, for comparing the count from the conditioning circuit with predetermined parameters representative of functional transducer operation and for inducing the second audio transducer to provide the back-up acoustic output if the count fails to be within the predetermined parameters.

3. The audio alarm circuit of claim 2 wherein the conditioning circuit includes an amplifier for amplifying the electrical signal from the second audio alarm circuit to provide an amplified signal, and a threshold detector for converting the amplified signal to the countable signal.

4. The audio alarm circuit of claim 1 wherein the second transducer is a piezoelectric transducer.

5. The audio alarm circuit according to claim 1 wherein the detector includes an auto-diagnostic line connected to the second audio alarm circuit to afford monitoring of the second audio alarm circuit by the detector and for informing the detector of an internal sensed parameter existing within the audio alarm circuit itself, and the processing circuit is adapted to elicit audio output from the first audio transducer upon being informed of the existence of an internal sensed parameter within the audio alarm circuit.

6. The audio alarm circuit of claim 1 wherein the audio alarm includes a main power source and an auxiliary power source; and means for providing acoustic output from the second audio transducer upon failure of the main power source.

7. The audio alarm circuit according to claim 1 wherein the first and second transducers each comprise a generally disc-shaped housing comprising a tubular peripheral wall having an axis, axially spaced ends, and first and second opposite end walls one attached to each end of the peripheral wall; the first end wall having a sound egress aperture adapted to direct passage of audio output therethrough in a direction generally parallel to the axis.

8. An audio alarm circuit according to claim 7 wherein:

the second end wall of the first transducer is situated in contact with the second end wall of the second transducer, and the axis of the first transducer is aligned with the axis of the second transducer, and the second audio transducer further comprises a length of pressure sensitive adhesive tape covering the sound egress aperture.

9. An audio alarm circuit according to claim 7 wherein the first and second transducers are situated with the axis of the first transducer spaced from the axis of the second transducer, and the audio alarm circuit further comprises acoustic propagation means attached to the first and second transducers to thereby couple the first and second transducers, whereby the acoustic propagation means enhances the efficiency of the acoustical coupling of the first and the second transducers.

10. An alarm for providing a back-up output in response to a sensed parameter comprising:

a first alarm circuit having means for providing a first output in response to the sensed parameter;

a second alarm circuit having means for providing the back-up output in response to a predetermined fault condition, the means for providing the back-up output being coupled to the means for providing a first output; the second alarm circuit providing an electrical signal in response to the first output, and a detector means for responding to the sensed parameter and to the electrical signal, the detector means being adapted to provide the predetermined fault condition and to cause the second alarm circuit to provide the back-up output upon failure of the first alarm circuit to provide the first output.

11. An audio alarm for providing a back-up acoustic output in response to a sensed parameter comprising:

a first audio alarm circuit having means for providing a first acoustic output in response to the sensed parameter;

a second audio alarm circuit having means for providing the back-up acoustic output in response to a predetermined fault condition, the means for providing the back-up acoustic output being acoustically coupled to the means for providing a first acoustic output; the second audio alarm circuit providing an electrical signal in response to the first acoustic output, a detector means for responding to the sensed parameter and to the electrical signal and for providing the predetermined fault condition by interpreting the electrical signal from the second audio alarm circuit, and whereby the second audio alarm circuit provides the back-up acoustic output upon failure of the means for providing the first acoustic output to provide the first acoustic output.

12. A method of providing an audio alarm that provides a back up acoustic output in response to a sensed parameter comprising:

providing a first audio alarm circuit having a first transducer adapted to provide a first acoustic output in response to the sensed parameter;

providing a second audio alarm circuit having a second transducer adapted to provide the back-up acoustic output in response to a predetermined fault condition, acoustically coupling the second transducer to the first transducer;

providing an electrical signal from the second audio alarm circuit in response to the first acoustic output of the first transducer, providing a detector responsive to the sensed parameter and to the electrical signal, interpreting the electrical signal from the first audio alarm circuit by the detector to provide the predetermined fault condition, and initiating the back-up acoustic output from the second transducer upon failure of the first transducer to provide the first acoustic output.

13. A method of providing an audio alarm that provides a back-up acoustic output in response to a sensed parameter according to claim 12 wherein the step of providing the detector comprises:

providing a conditioning circuit for receiving the electrical signal from the second audio alarm circuit, the conditioning circuit being adapted to convert the electrical signal to a countable signal representative of transducer operating characteristics and to provide a count of the countable signal; and providing a processing circuit for receiving the count from the conditioning circuit, for comparing the count from the conditioning circuit with predetermined parameters representative of functional transducer operation and for eliciting the back-up acoustic output from the second audio transducer if the count fails to be within the predetermined parameters.

14. A method of providing an audio alarm that provides a back-up acoustic output in response to a sensed parameter according to claim 13 further comprising the steps of:

connecting an auto-diagnostic line between the second audio alarm circuit and the processing circuit, connecting an output line between the conditioning circuit and the processing circuit to permit the processing circuit to receive the count from the conditioning circuit, testing the second audio alarm and conditioning circuits by initiating an artificial fault condition to elicit the back-up acoustic output from the second audio alarm circuit, monitoring the auto-diagnostic line and the output line by the processing circuit to determine whether the second audio alarm circuit is operating, and providing a second audio alarm failure signal that induces audio output from the first audio alarm circuit upon determining that the second audio alarm circuit has failed.

15. A method of providing an audio alarm that provides a back-up acoustic output in response to a sensed parameter according to claim 13 further comprising the steps of:

at a predetermined time, generating a test signal from the processing circuit to the first audio alarm circuit to induce the first audio alarm circuit to provide the first acoustic output, monitoring the conditioning circuit by the processing circuit to verify that the audio alarm circuit is functioning properly, and providing a failure signal to indicating means upon a failure to verify that the audio alarm circuit is functioning properly.

16. A method of verifying the operation of an audio alarm that provides a back-up acoustic output in response to a sensed parameter comprising the steps of:

providing first and second alarm circuits adapted to provide primary and back-up acoustic outputs respectively, acoustically coupling the first alarm circuit to the second alarm circuit such that the second alarm circuit provides an electrical signal in response to the primary acoustic output, providing a detector circuit connected to the first and second alarm circuits, the detector being adapted to monitor the electrical signal of the second alarm circuit, and adapted to elicit acoustic output from the first and second alarm circuits, connecting an auto-diagnostic line between the second alarm circuit and the detector circuit to afford monitoring of internal elements of the second alarm circuit by the detector, initiating the back-up output from the second alarm circuit, monitoring the auto-diagnostic line and the electrical signal from the second alarm circuit by the detector circuit, determining whether the second alarm circuit is operating, and providing a second alarm circuit failure signal to indicating means upon determining that the second alarm circuit has failed.

17. A method of verifying the operation of an audio alarm that provides a back-up acoustic output in response to a sensed parameter according to claim 16 wherein the step of determining whether the second alarm circuit is operating includes:

comparing the electrical signal from the second alarm circuit with preprogrammed predetermined parameters representative of proper transducer operation.

18. A method of verifying the operation of an audio alarm that provides a back-up acoustic output in response to a sensed parameter according to claim 16 wherein the indicating means comprises the first alarm circuit.

19. A method of verifying the operation of an audio alarm that provides a back-up acoustic output in response to a sensed parameter comprising the steps of:

providing first and second alarm circuits adapted to provide primary and back-up acoustic outputs respectively, acoustically coupling the first alarm circuit to the second alarm circuit such that the second alarm circuit provides an electrical signal in response to the primary acoustic output, providing a detector circuit connected to the first and second alarm circuits, the detector being adapted to monitor the electrical signal of the second alarm circuit, and adapted to elicit acoustic output from the first and second alarm circuits, initiating acoustic output from the first alarm circuit, monitoring the electrical signal from the second alarm circuit by the detector circuit, determining whether the alarm circuit is operating properly, and providing an alarm circuit failure signal to indicating means upon determining that the alarm circuit has failed.

20. A method of verifying the operation of an audio alarm that provides a back-up acoustic output in response to a sensed parameter according to claim 19 wherein the step of determining whether the alarm circuit is operating includes:

comparing the electrical signal from the second alarm circuit with preprogrammed predetermined parameters representative of proper transducer operation.

* * * * *